US005394569A

United States Patent [19]

Poirier et al.

[11] Patent Number: 5,394,569

[45] Date of Patent: Mar. 7, 1995

[54] AIR VENTING APPARATUS FOR WC

[76] Inventors: Paul Poirier, Méme 1243 Borduas, Ste-Foy (Québec), Canada, G2E 4H1; Pierre Cetè, 1034 Long Sauht, Sainte-Foy QC., Canada, G1W 3Z9

[21] Appl. No.: 216,014

[22] Filed: Mar. 21, 1994

[51] Int. Cl.[6] ..... E03D 9/04

[52] U.S. Cl. ..... 4/213

[58] Field of Search ..... 4/213, 216, 347–352

[56] References Cited

U.S. PATENT DOCUMENTS

| | | | |
|---|---|---|---|
| 2,881,450 | 4/1959 | Tubbs | 4/213 X |
| 3,626,554 | 12/1971 | Martz | 4/213 |
| 4,031,574 | 6/1977 | Werner | 4/213 |
| 4,153,956 | 5/1979 | Fischer | 4/213 |
| 4,166,298 | 9/1979 | Pearson | 4/213 |
| 4,318,192 | 3/1982 | Williams et al. | 4/213 |
| 5,054,130 | 10/1991 | Wilson | 4/213 |

*Primary Examiner*—Charles E. Phillips

*Attorney, Agent, or Firm*—Pierre Lespérance; Francois Martineau

[57] ABSTRACT

An air venting apparatus to be mounted into the water tank of a water closet for evacuating to the outside of the room where the water closet is located the stale air escaping from the toilet bowl. The apparatus comprises a main, generally closed air chamber; a powered fan member, anchored into the air chamber for developing negative pressure therein; a support for supporting the air chamber at the top portion of the water tank whereby the fan remains constantly above water level. A siphon assembly is provided for fluidingly interconnecting in substantially air tight fashion the discharge pipe to an upstream section of the air chamber, whereby the siphon assembly is adaptable to fit discharge pipes of variable locations within the water tank; and a nozzle assembly is provided for fluidingly interconnecting a downstream end of the air chamber to the outside of the room. No modification of the water tank nor the water tank lid is required for the installation of this apparatus.

6 Claims, 4 Drawing Sheets

AIR VENTING APPARATUS FOR WC

FIELD OF THE INVENTION

This invention relates to devices for the evacuation to a remote location of stale air generated during use of water closets.

BACKGROUND OF THE INVENTION

Toilet bowl venting systems have been known for quite some time. The original type of such venting system included biasing means (e.g. a motor driven fan) for biasing air flow from the bowl of a toilet, through its water tank, and out to a remote point. Usually, these known systems required that the water tank lid be sealed by a sealing gasket, and that a bore be made through the porcelaine body of the water tank: see U.S. Pat. No. 5,029,346 issued Jul. 9, 1991 to Robert FERNALD. Clearly, such an arrangement is unsatisfactory, because the tank body must be broken, to make way for the stale air outlet pipe, and must be modified to accommodate a sealing gasket about its lid.

U.S. Pat. No. 4,153,956 issued May 15, 1979 to Raymond jr and Raymond sr FISCHER, discloses a toilet deodorizing apparatus, showing the concept of hanging an air fan to a panel which rests on the top of a WC water tank, so as not to need to physically alter the cover. In this patent, a plate 16 is provided to support the stale air processing unit 12 spacedly over water level in the tank. It is understood that plate 16 is in fact a diaphragm which is sealed along the periphery of the tank T by a frame 18 and this air filtering diaphragm is gaz permeable. Hence, the stale air is not evacuated but rather processed (i.e. filtered) through an air scrubbing device, to be thereafter returned into the room. The unit 12 includes a fan and a heater, the latter disposed at the outlet of the blower for deodorizing the stale air by the application of extreme heat. The thus purified air is then directly evacuated into the room, the cover C being raised by the spacer members 20, as illustrated in FIG. 2 of this patent.

In other known devices, there is disclosed charcoal-based air filtration means for processing stale air from WC: see for instance the following U.S. Pat. Nos.:

4,031,574
4,583,250
5,231,705

This is not cost-effective.

Still other devices require that a suction assembly be installed into the wall, ceiling or flooring of a room, thus introducing large installation costs, not to speak of safety hazards including fire hazards.

OBJECTS OF THE INVENTION

The gist of the present invention is therefore to provide a stale air controled discharge apparatus for water closet, which is adaptable to a variety of different models from different manufacturers of water closets, particularly in view of varying locations of the overflow pipe relative to the walls of the water tank proper.

A corollary object of the invention is to provide such a ventilating apparatus, which is sufficiently compact to fit within the water tank in an inconspicuous fashion.

An object of the invention is that the present air discharge apparatus be able to fit against the discharge pipe of the WC water tank, without hampering in any way its normal operations (i.e. when water level raises and exceeds the top mouth of the discharge pipe).

SUMMARY OF THE INVENTION

In accordance with the objects of the invention, there is disclosed an air venting apparatus to be mounted within the water tank of a water closet for evacuating to the outside of the room where the water closet is located the stale air escaping from the toilet bowl, said water tank being of the type including a top edge releasably closed by a lid with a discharge pipe, the latter extending through the water inside the water tank and defining a mouth normally above water level and extending short of the tank top edge; said apparatus comprising:

(a) a main, generally closed, air chamber member;

(b) a powered fan member, anchored into said air chamber member, for developing negative pressure therein;

(c) stay means for supporting said air chamber member at the top portion of said water tank spacedly over water level, whereby said fan member remains constantly above said water level;

(d) siphon means for fluidingly interconnecting in substantially air tight fashion said discharge pipe to an upstream section of said air chamber member, whereby said siphon means is adaptable to discharge pipes of variable locations within said water tank; and (e) air outlet means, for fluidingly interconnecting a downstream end of said air chamber member to the outside of the room; wherein no modification of the water tank nor the water tank lid is required for the installation of said apparatus.

Preferably, said siphon means includes an eccentric casing, said eccentric casing including: (a) an upstream mouth, adapted to remain submerged into the water of said water tank during operation of said air suction apparatus; (b) a downstream mouth, connected to said main air chamber member for relative movement thereabout, said downstream mouth located at a level above said water level; and (c) a labyrinth air passageway, extending between said upstream and downstream mouths and defining an upstream part, located above water level, a downstream part, located substantially below water level, and an intermediate section, vertically bridging said upstream and downstream parts.

Advantageously, said air outlet means includes a nozzle member, extending over the tank top edge but beneath a corresponding section of the tank lid; said nozzle member for engagement through a bore made into a proximate upright wall of said room. The nozzle member could then be telescopingly extendible, to adapt to variable set distances between said water tank and said proximate upright wall of said room.

It is envisioned that said fan member would include a motor, a drive shaft downwardly extending from said motor, and blade members rotatively carried by said drive shaft; and said stay means including a flat panel, resting over said tank top edge, and bolt means, bolting said motor against the underface of said flat panel.

Profitably, said fan member includes a motor, a drive shaft downwardly extending from said motor, and blade members rotatively carried by said drive shaft; and said stay means including a flat panel, resting over said tank top edge, a number of rigid elbowed rods, anchored at their ends to said panel and extending beneath and anchored to and supporting said motor at their intermediate portions. Said flat panel could also further include an edgewise spacer member, said spacer member engaging the flange formed by said lid above said flat panel to prevent accidental upward play of said flat panel.

DETAILED DESCRIPTION OF THE DRAWINGS

Figure 1:
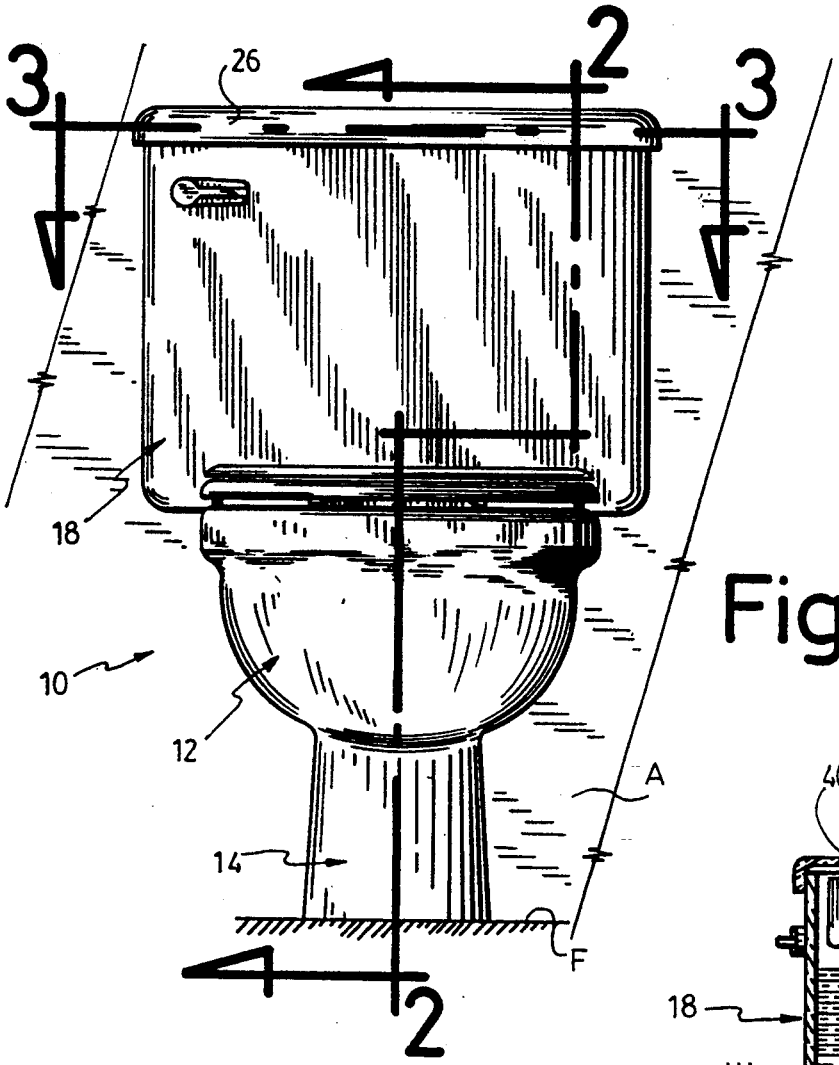
FIG. 1 is a front elevational view of a water closet.
Figure 2:
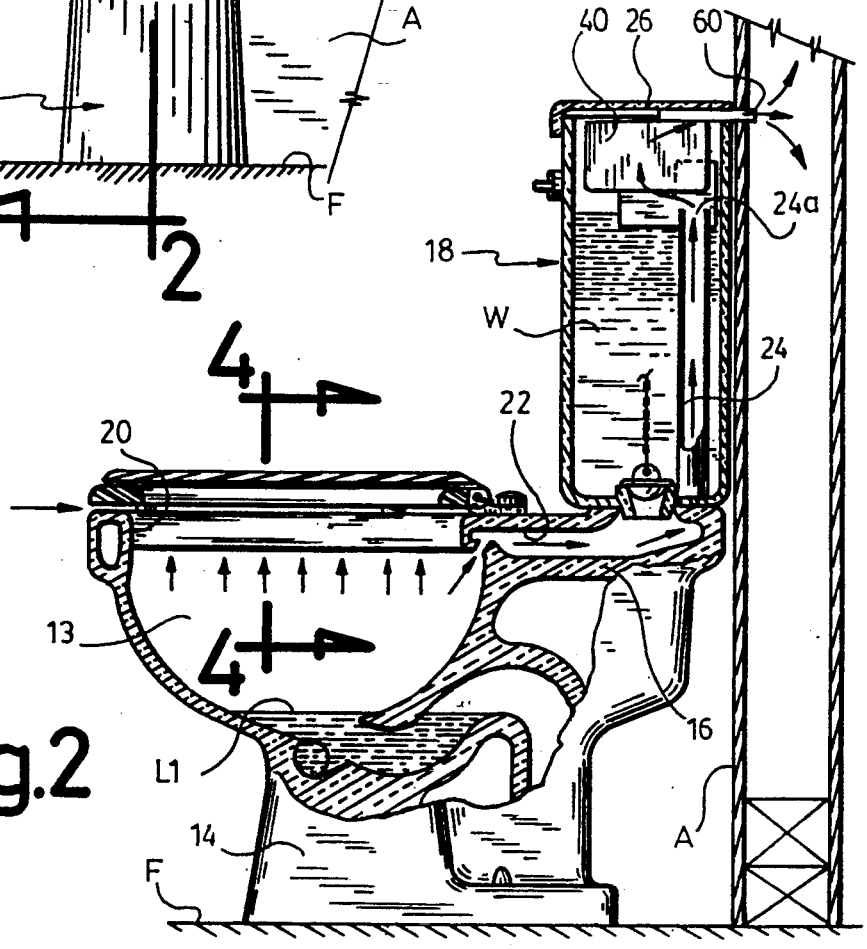
FIG. 2 is a side elevational, partly sectional view of a water closet taken along broken line 2—2 of FIG. 1, showing the stale air discharge device according to the invention, and a section of the adjacent wall of the room.

Water closet 10 conventionally consists of a bowl 12, supported over ground floor F by a pedestal 14, and itself carrying along its rear integral extension 16 an upstanding water tank 18. Water closet 10 is usually located proximate an upright wall A, whereby upright tank 18 may abut flatly against this upright wall A, to make efficient use of available space.

External access to the internal air volume 13 of bowl 12 is made possible via large top circular mouth 20, while the bowl air volume 13 and the tank 18 are fluidingly interconnected by an elbowed channel 22 which extends through extension 16 proximate the level of mouth 20 and into an overflow pipe 24 which extends upwardly through the tank. Bowl 12 includes a bodoy of water W up to (variable) water level L1, while tank 18 includes a (variable) body of water W up to water level L2. Water level L1 extends short of channel 22, while vertical overflow pipe 24 includes a top mouth 24*a* adapted to extend upwardly beyond the water level L2. Hence, the top air volume 25 inside tank 18 and above water level L2 is adapted to be in fluid communication with the lower air volume 13 of the toilet bowl 12 via overflow pipe 24 and channel 22. The top air volume 25 is bounded at its top end by a releasable tank lid or cover 26, resting by its own weight against the top mouth edge 18a of the porcelaine tank 18.

Figure 5:
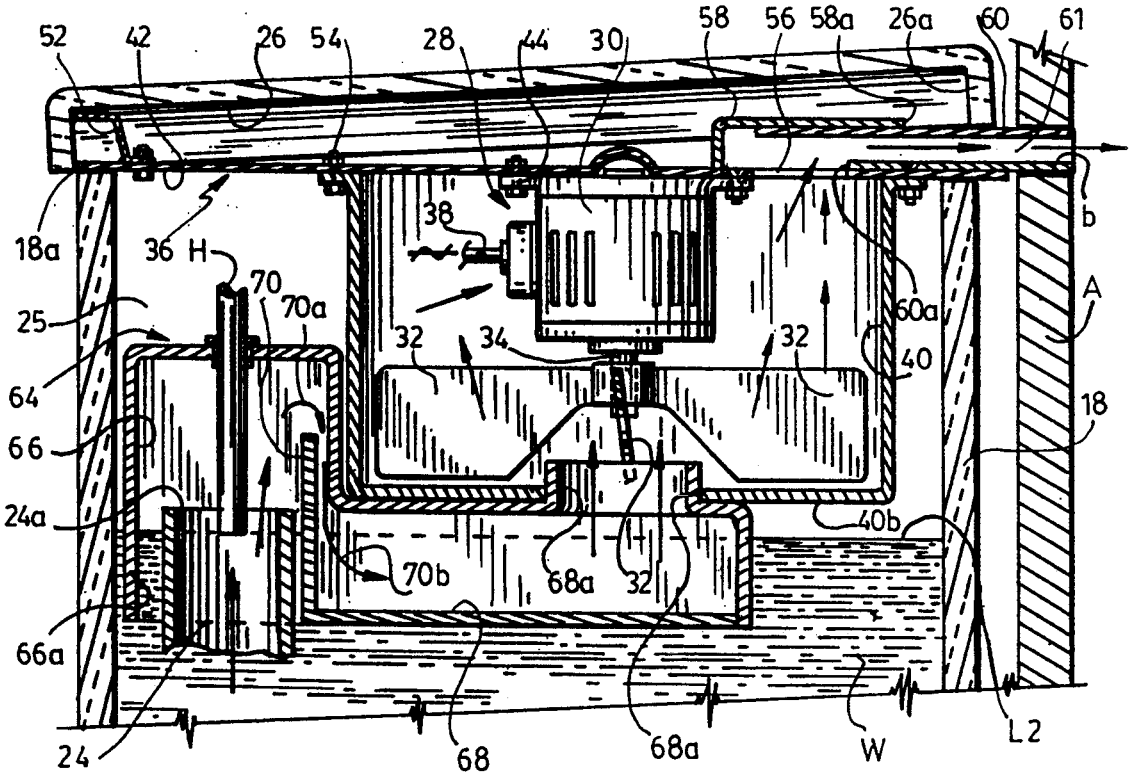
FIGS. 5 and 5*a* are enlarged cross-sectional views taken along line 5—5 of FIG. 3, illustrating two embodiments of fan motor stays.
Figure 6:
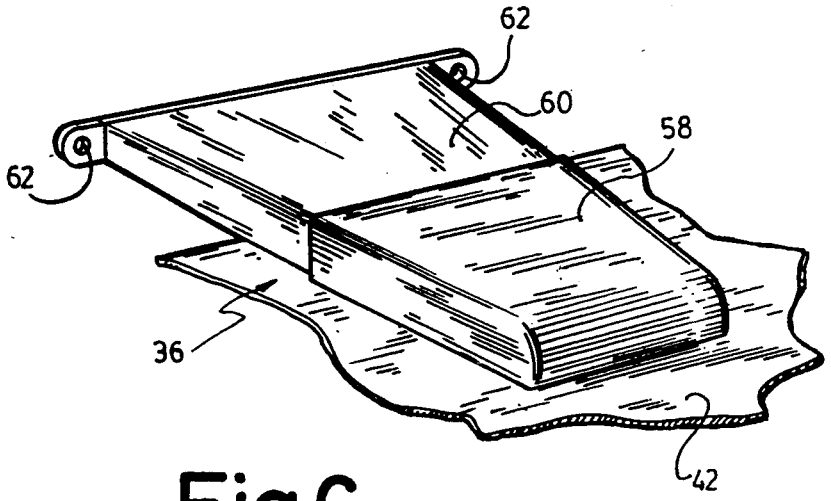
FIG. 6 is an isometric view of the discharge nozzle.

According to the invention, and as illustrated in FIG. 5, there is provided suction pump means for promoting air circulation from the overflow pipe 24, upwardly through its top mouth 24*a*, across the top air volume 25 and through and beyond the tank body 18. Such air circulation means includes a fan member 28 defining a motor 30 driving blades 32 via a drive shaft 34. The motor 30 is supported by stay means 36 over the tank top mouth edges 18*a*, so that its drive shaft 34 extend downwardly in a generally vertical fashion, whereby the fan blades 32 are located beneath the fan motor, as illustrated. The motor 30 may preferably be electrically powered (e.g. a 120 volt type) via power source line 38, to the conventional wall plug in the room, although other power means are not to be excluded from the scope of this invention. The motor 30 is enclosed inside a substantially airtight housing or main air chamber member 40, and is supported by a flat panel 42 extending above said motor 30, either directly via bolts 44 (FIG. 5) or indirectly via a pair of equidistant U-shape rods 46 (FIG. 5*a*) extending beneath the motor 30'. The elbowed free ends 46*a* of rods 46 are anchored to upstanding panel 42 by bolts 48, while the intermediate horizontal section 46*b* of these rods 46 is anchored to motor 30' by bolts 50.

Panel 42 simply rests flatly by its own weight against the top mouth 18*a* of the tank 18; but preferably further includes a spacer member 52 engaging a portion of the flange 26*a* of cover 26. Housing 40 is itself anchored to upstanding panel 42 by bolts 54.

A restricted aperture 56 is made through upper panel 40, within housing 40, and an elbowed socket 58 is made to extend outwardly therefrom integrally to panel 40. Socket 58 defines a mouth 58*a* extending within an axis generally parallel to and slightly above panel 42, i.e. substantially horizontally. Mouth 58*a* is engaged by a hollow elongated casing 60, which is open at both ends and is sized to fit therein in a friction fit, male/female type coupling. Casing 60 defines a lengthwise passageway 61. For example, socket 58 and casing 60 are cross-sectionally quadrangular. By lifting one side of cover 26, casing 60 will be able to extend between the cover flange 26*a* and the tank top mouth 18*a;* and by thereafter releasing the lid 26, the casing 60 will be locked in position by the weight of the (heavy) porcelaine cover 26. Casing 60 includes at its outer end a pair of outturned ears 62, for screwing engagement with the room wall A, so that the casing lengthwise passageway 61 remain in register with and engage a bore b made in the room wall A.

The purpose of outer casing 60 is to be able to telescopingly extend from inner socket 58, to adapt to variable set distances between the water tank 18 and the wall A, without compromising the integrity of the structural interconnection between socket 58 and coextensive panel 42. As suggested in FIG. 5, the lower part 60*a* of the inner end of casing 60 may be recessed, to clear aperture 56 at all times, including when casing 60 is substantially engaged into its socket 58; this to prevent hampering the air outflow.

It is understood that with this design, there is no need to bring modifications to the water tank body, 18, i.e. a through-bore, since the air discharge nozzle member 58, 60, extends above the tank top mouth 18*a*.

To ensure that stale air escaping from overflow pipe 24 through mouth 24*a* does not accidentally escape from air volume 25 by seeping between the tank mouth 18*a* and the cover downturned flange 26*a*, a labyrinth siphon member 64 is provided to interconnect the pipe mouth 24*a* to the fan housing 40. Critically, the labyrinth member 64 is partially submerged into the water of the water tank 18, so that an operative air tight interconnection can be obtained without any physical airtight joint (no gasket is required). More particularly, labyrinth member 64 includes first and second vertically offset parts 66 and 68, the former having a submerged bottom mouth 66*a* freely opening into the discharge pipe mouth 24*a*, and the latter having an upper nipple mouth 68*a* opening into fan housing 40 snugly via an air intake port 40*a* made through the bottom wall 40*b* of the housing 40. Mouth 66*a* is submerged while labyrinth part 66 projects upwardly outwardly from water W. The second labyrinth part 68 is positioned in such a way—in relation to the base wall 40*b* of the fan housing 40—as to extend beneath the level of the discharge pipe mouth 24*a*, i.e. being mostly submerged into water W, but for the nipple mouth 68*a* which extends upwardly outwardly from water level L2. Parts 66 and 68 communicate with one another via an intermediate vertical air channel 70. Channel 70 defines a top air intake mouth 70*a*, opening into part 66 above the level of vertical pipe mouth 24*a*, and a bottom air outlet mouth 70*b*, opening beneath the level of vertical pipe mouth 24*a*.

It is understood that, in view of the siphon principle, no stale air escaping from pipe 24 will be able to seep outwardly from labyrinth parts 66, 68, through the water body W of tank 18, and from housing 40, since:

(a) both the lower mouth 66*a* of labyrinth part 66 and the lowest part of the coextensive labyrinth part 68 are submerged in water; and (b) parts 66 and 68 are separated by a partition wall 71 (bounding vertical channel 70) which bridges the water level L2.

Moreover, although tubular nipple 68*a* should snugly (preferably frictionally) engage with the mouth 40*a* of the housing base wall 40, there is no need for this interengagement to be completely air-tight (no gasket is required); the reason for this being that, since the rotating blades 32 create a negative pressure about nipple 68*a*, no air backflow should occur.

Figure 3:
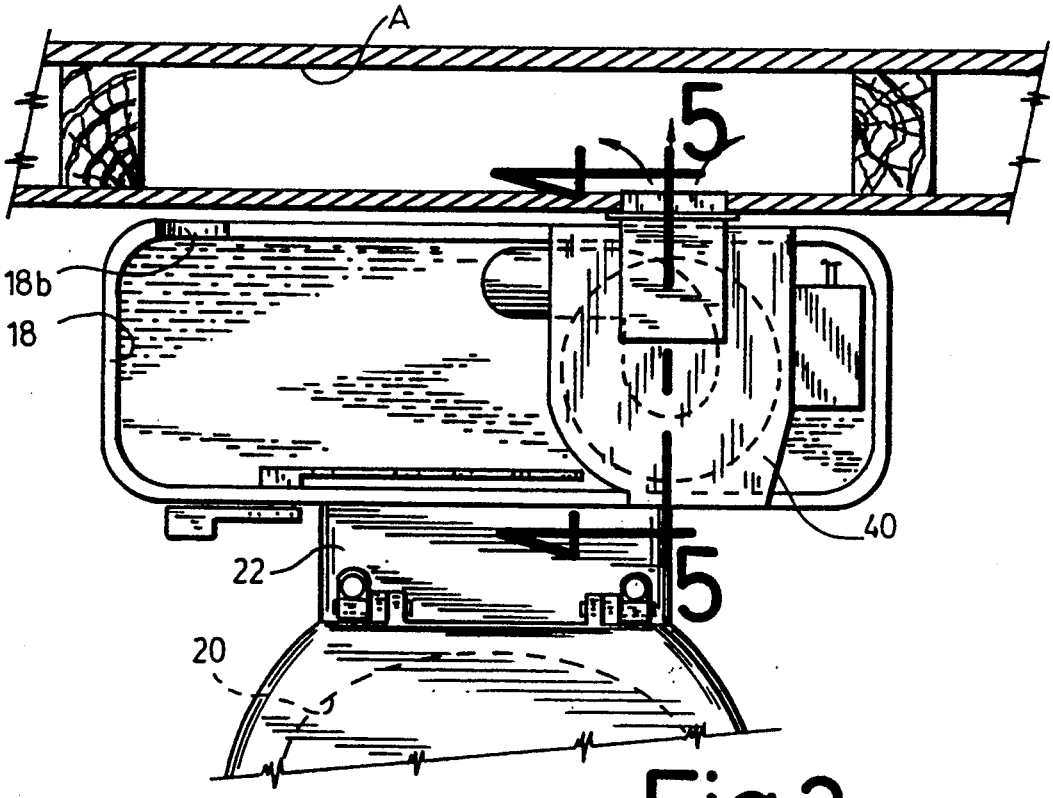
FIGS. 3–3*a* are cross-sectional views, at a slightly enlarged scale, of the water tank, taken along line 3—3 of FIG. 1, showing two different embodiments of water closets.
Figure 3A:
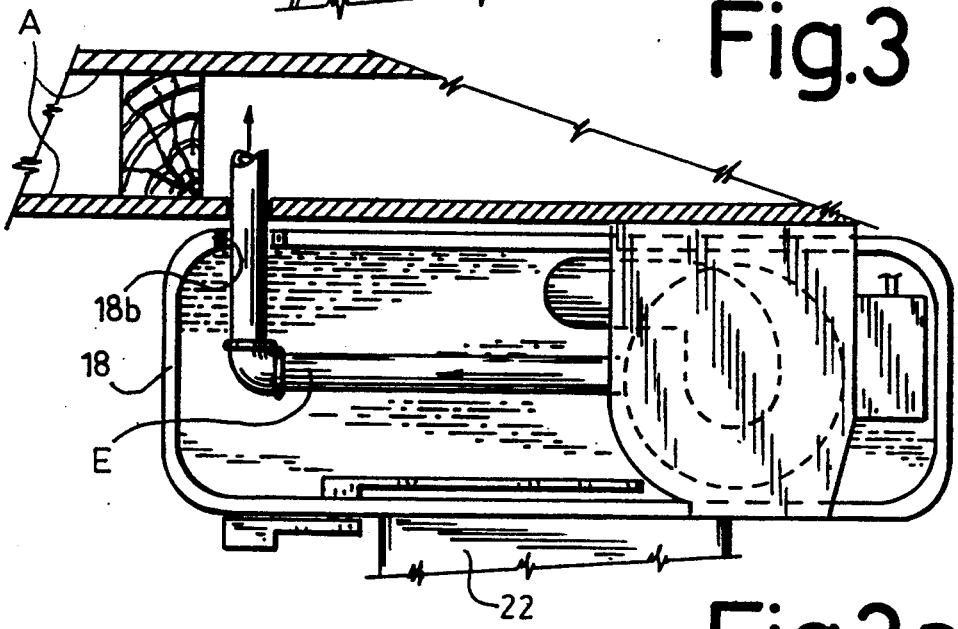
Figure 4:
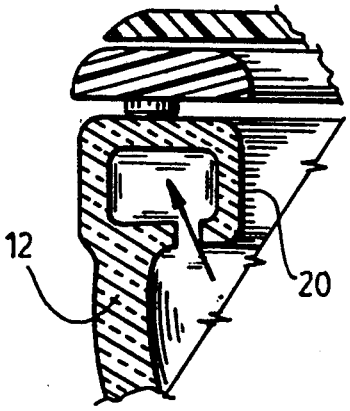
FIG. 4 is an enlarged cross-section taken along line 4—4 of FIG. 2.

Accordingly, and as suggested by the arrows in FIGS. 1 and 5, upon powering fan motor 30, negative air pressure will develop into bowl enclosure 13. This will therefore induce air flow circulation from the toilet bowl enclosure, through the conventional water discharge apertures and annular discharge channel, through horizontal channel conduit 22, upwardly along overflow pipe 24, through the top mouth 24*a* thereof, into labyrinth parts 66, 70, 68, respectively, through nipple 68*a* and into housing 40; to be thereafter expelled from housing through air outlet port 56, into the passageway 61 of air discharge nozzle member 58, 60, and outwardly of wall A via outlet port b. For example, air discharge nozzle 58, 60, may be connected to a discharge hose E (as suggested in FIG. 3*a*) leading to outside of the dwelling, for evacuation of stale air from the dwelling; or alternately, may simply be ejected within the hollow wall A (as suggested in FIG. 3).

Figure 5A:
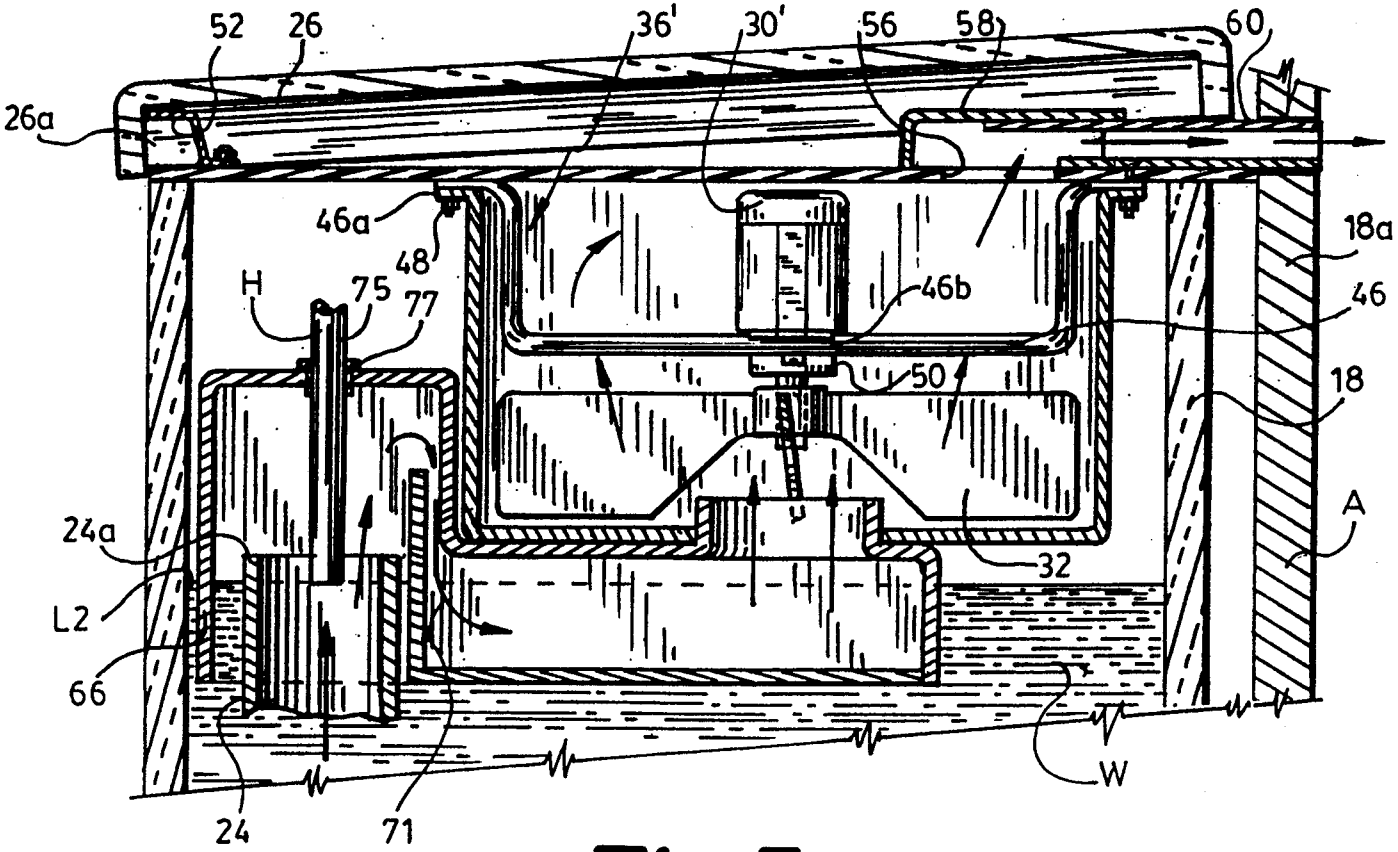

It is noted that FIG. 5*a* differs from FIG. 5 by the selected stay member 36' for the motor 30'. Motor 30' is also shown to be of smaller volume, although this is not critical.

It can now be readily understood by those skilled in the art that the present stale air controled discharge apparatus for water closet is adaptable to a variety of different models of water closets, particularly in view of varying locations of the overflow pipe 24 relative to the walls of the water tank proper 18. Since labyrinth member 64 has—as illustrated in FIGS. 5 and 5*a*—an upper contour sized to fit against the lower contour of the fan motor housing 40, it is by the weight of the tank cover 26 that the labyrinth member 64 will be maintained in a partially submerged condition—via panel 36 and underlying housing 40. Hence, to adapt to different W.C. (particularly those where the position of the upright overflow pipe 24 changes), one needs only to rotate the labyrinth part 66 around the fan housing 40, to bring mouth 66*a* in register with the corresponding pipe mouth 24*a*. Because of the eccentric shape of the labyrinth member 64, the rotating or swivelling action thereof about mouth 40*a* will not hamper the siphon-based air tight joint of labyrinth member 64 with housing chamber 18.

The careful reader will have noticed that the present stale air discharge system does not hamper in any way the regular operation of the overflow pipe 24. Indeed, upon water level L2 raising to reach a level exceeding that of the pipe mouth 24, water W will overflow through mouth 24*a* and into pipe 24. At that time, stale air moving upwardly through pipe 24 will not be able of course to escape from the pipe, but this will be temporary, i.e. until water level L2 has returned to a more normal level i.e. below that of mouth 24*a* of the discharge pipe 24. When this situation resumes, the air discharge system of the invention automatically becomes fully operational once again. The reason for this is that the mouth 24*a* of pipe 24 remains always free (no airtight physical joint is used); it is only through the siphon principle that air escaping from pipe 24 is prevented from seeping outwardly from the system and to the room. Another advantageous feature of this invention is that fan motor 30 should never be subjected to contact with water, since it is supported by panel 42 and since it is located above the level of overflow pipe top mouth 24*a*.

Of course, when water level L2 momentarily drops beneath the level of the bottom section of siphon member 64 (as when the water in the toilet bowl is flushed), siphoning action momentarily stops for a brief period of time. Also, it is understood that the conventional fresh water intake hose H (FIGS. 5–5*a*) that opens into the discharge tube mouth 24*a* (to feed fresh water into the bowl enclosure after contaminated water therein has been flushed) should be made to engage a bore 75 at the top of labyrinth casing part 66 via an air-tight joint 77—here to prevent air seeping outwardly therethrough.

The various elements of the present invention could be made of any suitable, waterproof, rigid material, e.g. a cheap plastic material.

I claim:

1. An air venting apparatus to be mounted into the water tank of a water closet for evacuating to the outside of the room where the water closet is located the stale air escaping from the toilet bowl, said water tank being of the type including a top edge releasably closed by a lid with a discharge pipe extending through the water inside the water tank and defining a mouth normally above water level in the tank and extending short of the level of the tank top edge; said apparatus comprising:

(a) a main, generally closed, air chamber member;

(b) a powered fan member, anchored to said air chamber member, for developing negative pressure therein; (c) stay means for supporting said chamber member at the top portion of said water tank spacedly above said water level;

(d) siphon means for fluidingly interconnecting in substantially air tight fashion said discharge pipe to an upstream section of said air chamber member, whereby said siphon means is adaptable to fit discharge pipes of variable locations within said water tank wherein said siphon means includes an eccentrically shaped casing, said casing including:

(1)an upstream mouth, adapted to remain submerged into the water of said water tank during operation of said air venting apparatus;

(2) downstream mouth, connected to said main air chamber member for relative movement thereabout said downstream mouth located at a level above said water level; and (3) a labyrinth air passageway, extending between said upstream and downstream mouths and defining an upstream part, located above water level, a downstream part, located substantially below water level, and an intermediate section, vertically bridging said upstream and downstream parts; and (e) air outlet means, for fluidingly interconnecting a downstream end of said air chamber member to the outside of the room; wherein no modification of the water tank nor the water tank lid is required for the installation of said apparatus.

2. An air venting apparatus as defined in claim 1, wherein said fan member includes a motor, a drive shaft downwardly extending from said motor, and blade members rotatively carried by said drive shaft; and said stay means including a flat panel, resting over said tank top edge, a number of rigid elbowed rods, anchored at their ends to said panel and extending beneath and anchored to and supporting said motor at their intermediate portions.

3. An air venting apparatus as defined in claim 1, wherein said air outlet means includes a nozzle member, extending over the tank top edge but beneath a corresponding section of the tank lid; said nozzle member for engagement through a bore made into a proximate upright wall of said room.

4. An air suction apparatus as defined in claim 3, wherein said nozzle member is telescopingly extendible, to adapt to variable set distances between said water tank and said proximate upright wall of said room.

5. An air venting apparatus as defined in claim 1, wherein said fan member includes a motor, a drive shaft downwardly extending from said motor, and blade members rotatively carried by said drive shaft; and said stay means including a flat panel, resting over said tank top edge, and bolt means, bolting said motor against the underface of said flat panel.

6. An air venting apparatus as defined in claim 5, wherein said flat panel includes an edgewise spacer member, said spacer member engaging the flange formed by said lid above said flat panel to prevent accidental upward play of said flat panel.

* * * * *